US009261859B2

(12) United States Patent
Rochat

(10) Patent No.: US 9,261,859 B2
(45) **Date of Patent: *Feb. 16, 2016**

(54) UNIVERSAL RUNNING EQUATION OF TIME MECHANISM AND METHOD OF SETTING THE SAME

(71) Applicant: BLANCPAIN SA, Le Brassus (CH)

(72) Inventor: Marco Rochat, Le Brassus (CH)

(73) Assignee: Blancpain SA, Le Brassus (CH)

( * ) Notice: Subject to any disclaimer, the term of this patent is extended or adjusted under 35 U.S.C. 154(b) by 0 days.

This patent is subject to a terminal disclaimer.

(21) Appl. No.: 14/381,451

(22) PCT Filed: Feb. 21, 2013

(86) PCT No.: PCT/EP2013/053410

§ 371 (c)(1),
(2) Date: Aug. 27, 2014

(87) PCT Pub. No.: WO2013/127681

PCT Pub. Date: Sep. 6, 2013

(65) Prior Publication Data

US 2015/0103635 A1 Apr. 16, 2015

(30) Foreign Application Priority Data

Feb. 27, 2012 (EP) ..... 12157118

(51) Int. Cl.
*G04B 19/26* (2006.01)
*G04B 19/23* (2006.01)

(52) U.S. Cl.
CPC ..... *G04B 19/262* (2013.01); *G04B 19/23* (2013.01); *G04B 19/235* (2013.01)

(58) Field of Classification Search
CPC ..... G04B 19/22; G04B 19/23; G04B 19/262; G04B 19/235
USPC ..... 368/14–17, 20
See application file for complete search history.

(56) References Cited

U.S. PATENT DOCUMENTS 1,459,710 A 6/1923 Balch
5,184,333 A * 2/1993 Caspar ..... 368/28

(Continued)

FOREIGN PATENT DOCUMENTS

EP 1 286 233 A1 2/2003
EP 1 343 056 A1 9/2003
EP 1 637 941 A1 3/2006

OTHER PUBLICATIONS

Machine translation of EP1637941, retireved from the internet on Apr. 6, 2015.*

(Continued)

*Primary Examiner* — Vit W Miska
(74) *Attorney, Agent, or Firm* — Oblon, McClelland, Maier & Neustadt, L.L.P.

(57) ABSTRACT

Universal running equation of time mechanism including a differential device outputting a running equation minute, the running equation minute driving a true minute which, via a true equation motion work drives a true hour, the civil time minute cannon-pinion driving, via a motion work wheel set, a civil hour wheel, a jumper spring, integral with the civil hour wheel, cooperating with a star having twelve teeth connected to an arbor carrying a civil hour hand, a time zone wheel also being integral with the arbor, a time difference and display train applying the time difference linked to the longitude position of the user relative to the center of the time zone to the true running equation hour, the time zone wheel applying to the civil hour wheel, in forward or backward one-hour steps, the time difference between the civil time at the place where the user is situated and the time at the center of the time zone.

7 Claims, 4 Drawing Sheets

(56) References Cited

U.S. PATENT DOCUMENTS

| | | | | |
|---|---|---|---|---|
| 5,253,225 | A * | 10/1993 | Vaucher | 368/20 |
| 6,826,122 | B2 * | 11/2004 | Zaugg | 368/28 |
| 7,372,781 | B2 | 5/2008 | Loth | |
| 2003/0031093 | A1 * | 2/2003 | Zaugg | 368/80 |
| 2005/0207283 | A1 | 9/2005 | Loth | |
| 2005/0219959 | A1 * | 10/2005 | Wiederrecht et al. | 368/220 |
| 2012/0243380 | A1 | 9/2012 | Goeller | |
| 2012/0243388 | A1 | 9/2012 | Goeller | |

OTHER PUBLICATIONS

International Search Report issued in corresponding application PCT/EP2013/053410, completed May 30, 2013 and mailed Jun. 6, 2013.

G.-A. Gerner, Illustrated Professional Dictionary of Horology I + II , published in 1961 and 1995, pp. 225, 441, and 631.

European Search Report issued in related U.S. Appl. No. 13/158,766, completed Aug. 14, 2013.

* cited by examiner

UNIVERSAL RUNNING EQUATION OF TIME MECHANISM AND METHOD OF SETTING THE SAME

This is a National Phase Application in the United States of International Patent Application PCT/EP2013/053410 filed Feb. 21, 2013, which claims priority on European Patent Application No. 12157118.6 of Feb. 27, 2012. The entire disclosures of the above patent applications are hereby incorporated by reference.

FIELD OF THE INVENTION

The present invention concerns a universal running equation of time mechanism. More specifically, the present invention concerns a running equation of time mechanism which accurately indicates the time at which the sun is at its zenith whatever the position, in terms of longitude, of the wearer of the watch.

BACKGROUND OF THE INVENTION

Within the same time zone, the sun is at its zenith at a different time depending on whether one is at the extreme east, at the center or extreme west of the time zone. There is a time difference of 59 minutes between the two extreme positions.

Moreover, the country in which the user is situated may not be aligned with the official time zone time. This is, for example, the case of Switzerland, which although within the Greenwich Time zone, has a one hour time difference with England.

Other countries have only one official time but their territory covers several time zones.

Finally, some countries change time according to the season (summer time/winter time).

By way of example, for someone in Neuchâtel (Switzerland) on 23 July, the sun will be at its zenith at 13:38 hours in civil time, namely: 12 hours (time zone time), +2 hours (summer time)−28 minutes (longitude of Neuchâtel: 7°)+6 minutes (difference from running equation of time). Conversely, for someone in London on the same day, the sun will be at its zenith at 13:06 hours in civil time, namely: 12 hours (time zone time)+1 hour (summer time)+0 minutes (longitude of London: 0°)+6 minutes (difference from running equation of time). Yet Neuchâtel and London are in the same time zone.

FIGS. 1, 2 and 3 annexed to this patent application illustrate the prior art differential device to which the universal running equation of time mechanism of the invention applies.

This differential device is described in detail in European Patent Application No 1286233 in the name of the Applicant. Let us recall that FIGS. 1, 2 and 3 annexed to this patent application and taken from the aforementioned European Patent Application, show, in particular, the equation of time cam 1 whose profile is determined by the difference, for each day of the year, between mean solar time or civil time and true solar time.

Indeed, as is well known, there is a difference between true solar time, which is the time that elapses between two consecutive upper passages of the sun at the meridian of the same location, and mean solar time or civil time which is the mean duration in a year of all the true solar days. This difference between civil time and true time reaches +14 minutes 22 seconds on 11 February and −16 minutes 23 seconds on 4 November. These values vary very little from year to year.

The equation of time cam 1 is driven in rotation at the rate of one revolution per year from the simple or perpetual date mechanism comprised in the timepiece. Cam 1 carries a month disc 2 which rotates at the same speed and which matches the position of said cam 1 to the date indicated by the date mechanism so that the solar time minute hand 4 indicates the exact solar time.

The simple or perpetual date mechanism may be of any known type and will not be described in its entirety here. For a clear understanding, it is sufficient to know that this date mechanism drives equation of time cam 1 at the rate of one complete revolution per year. However, purely for the purpose of illustration, a date wheel set 6 driving a hand 8 which indicates the date (from 1 to 31) is shown. This date wheel set 6 rotates at the rate of one complete revolution per month. It is actuated by the date mechanism via an intermediate date wheel 10 for reversing the direction of rotation, and a reduction wheel set 12 for reducing the rotational speed from one complete revolution per month to one complete revolution per year.

The solar time minute hand 4 is driven by a differential gear 14 which has as respective inputs a gear train 16 driving a civil time minute hand 18 and a rack 20 which cooperates with equation of time cam 1 (rack 20 is shown in FIG. 1 in both of its end positions, once in a full line and the other time in dot and dash lines). More specifically, as seen in FIG. 1, differential gear 14 includes at least one and preferably two planetary wheels 22 driven by the motion work of the watch movement. These two planetary wheels 22 are capable of rotating on themselves and rolling over the inner toothing 24 of an equation of time wheel 26. The latter also has, on the external periphery thereof, a toothed sector 28 via which it cooperates with a toothed sector 30 comprised on one of the ends of rack 20. This rack is subjected to the return action of a spring (not shown) which is fixed to the watch frame and which tends to apply a feeler spindle 32, forming the other end of said rack 20, against the periphery of running equation of time cam 1. The solar time display train includes a pinion 34 placed at the center of differential gear 14 and carried by an arbour 36. This solar time display pinion 34 meshes with planetary pinions 22. It also carries a display wheel 38 which meshes with a cannon-pinion 40 onto the pipe of which there is driven the solar time minute hand 4. This gear train 38, 40 returns the solar time display to the center 42 of the watch movement, so that the solar time minute hand 4 is concentric with civil time minute hand 18.

The running equation of time mechanism which has just been described operates as follows.

In the normal operating mode of the watch, equation of time cam 1, equation of time rack 20 and thus equation of time train 26 are immobile. However, planetary pinions 22 are driven by the watch movement. Thus, they rotate on themselves and roll over the inner toothing 24 of equation of time wheel 26, driving solar time display pinion 34 in rotation, which permits the solar time minute hand 4 to rotate in a concomitant manner with civil time minute hand 18. The difference between solar time hand 4 and civil time hand 18 thus remains constant over a period of 24 hours.

Once per day, at around midnight, the running equation of time cam 1 pivots, driven by the date mechanism which changes the date from one day to the following day. At that precise moment, feeler spindle 32, which is in contact with the periphery of cam 1, in turn pivots rack 20. Said rack 20, in pivoting, drives equation of time wheel 26 in rotation. Planetary pinions 22, which are substantially immobile during this brief time interval (they make one complete revolution in one hour), rotate on themselves, driven in rotation by equation of time wheel 26 and in turn drive solar time display pinion 34 so as to precisely set the position of solar time minute hand 4 again.

Thus, the running equation of time mechanism described above can, at any time, display the time difference between mean solar time and true time, by means of a civil time minute hand and a solar time minute hand. This running equation of time mechanism does not, however, indicate the civil time at which the sun is at its zenith according to the position, in terms of longitude, of the user within the time zone.

SUMMARY OF THE INVENTION

It is an object of the present invention to overcome this problem by providing a running equation of time mechanism capable of indicating the difference in hours and minutes between civil time and true time, at any time and regardless of the longitude position of the user in the time zone.

To this end, the present invention concerns a universal running equation of time mechanism including a differential device, a first input of which is formed by a civil time minute cannon-pinion, and a second input of which is formed by a running equation of time cam, the differential device outputting a running equation minute, the running equation minute driving a true running equation minute which, via a true equation motion work, drives a true running equation hour, the civil time minute cannon-pinion driving, via a motion work wheel, a civil hour wheel, a jumper spring, integral with the civil hour wheel, cooperating with a star having twelve teeth connected to an arbor carrying a civil hour hand, a time zone wheel also being integral with the arbor, a time difference and display train, coupled to the true equation motion work, applying the time difference linked to the longitude position of the user relative to the center of the time zone to the true running equation hour, the time zone wheel applying to the civil hour wheel, in forward or backward one-hour steps, the time difference between the civil time at the place where the user is situated and the time at the center of the time zone.

Owing to these features, the present invention provides a universal running equation of time mechanism which is not only capable of displaying the difference between solar time and civil time, but is also capable of taking account of the difference between solar time and civil time inherent to the longitude position of the user relative to the center of the time zone. Thus, the universal running equation of time mechanism of the invention can display, at any time, the difference in hours and minutes between civil time at the location within the time zone where the user is situated and solar time.

BRIEF DESCRIPTION OF THE DRAWINGS

Other features and advantages of the present invention will appear more clearly from the following detailed description of one embodiment of the universal running equation of time mechanism according to the invention, this example being given solely by way of non-limiting illustration with reference to the annexed drawing, in which.

DETAILED DESCRIPTION OF THE INVENTION

The present invention proceeds from the general inventive idea which consists in providing a universal running equation of time mechanism which, for the solar time display, takes account of the difference between the civil minute and solar minute, of the difference associated with the longitude position of the user relative to the center of the time zone, and of the difference associated with any time difference between the civil time of the place where the user is situated and the official time at the center of the time zone.

Figure 1:
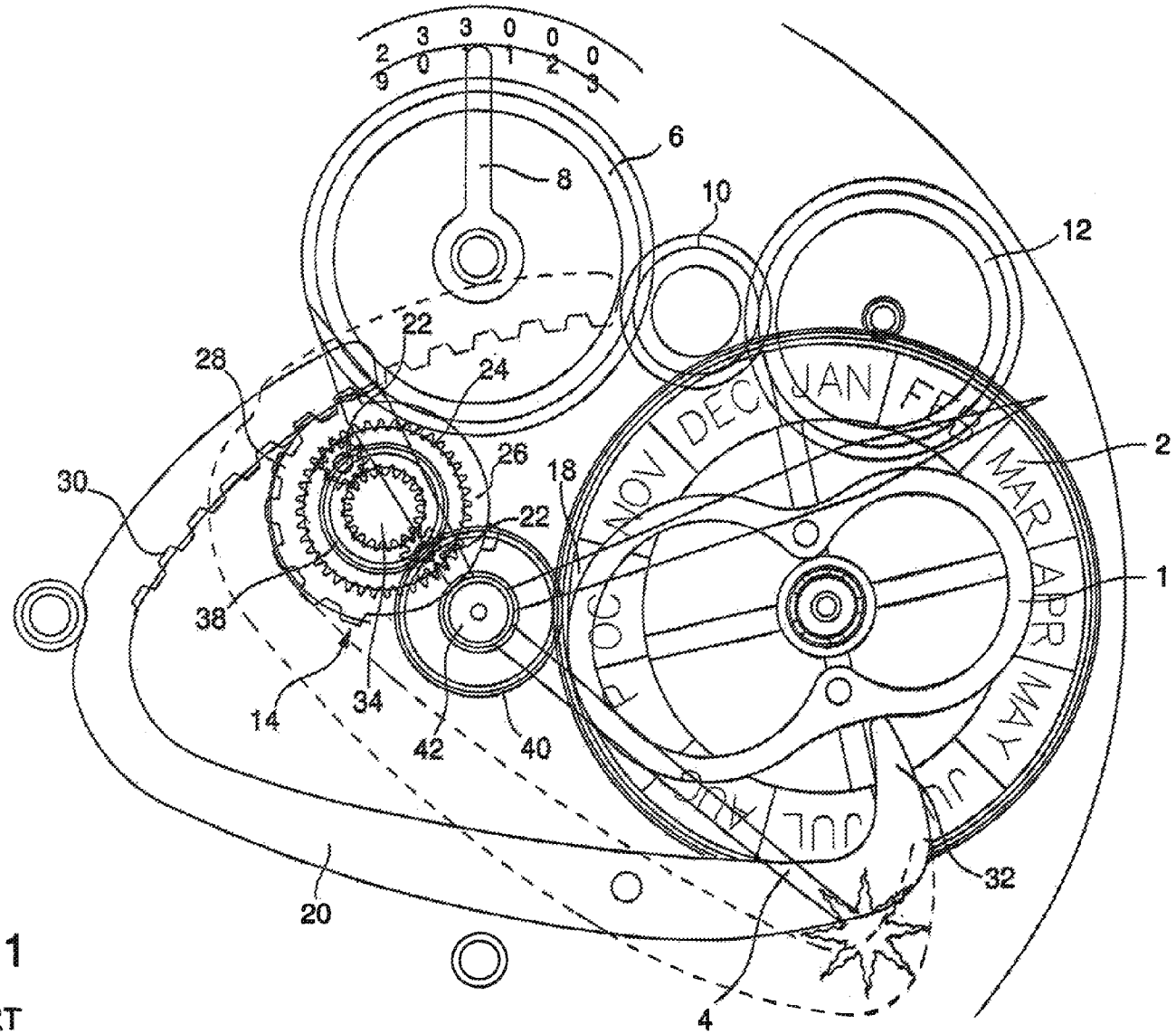
Fig. 1 PRIOR ART
FIG. 1, cited above, is a plan view of the running equation of time device to which the universal running equation of time mechanism of the invention applies.
Figure 2:
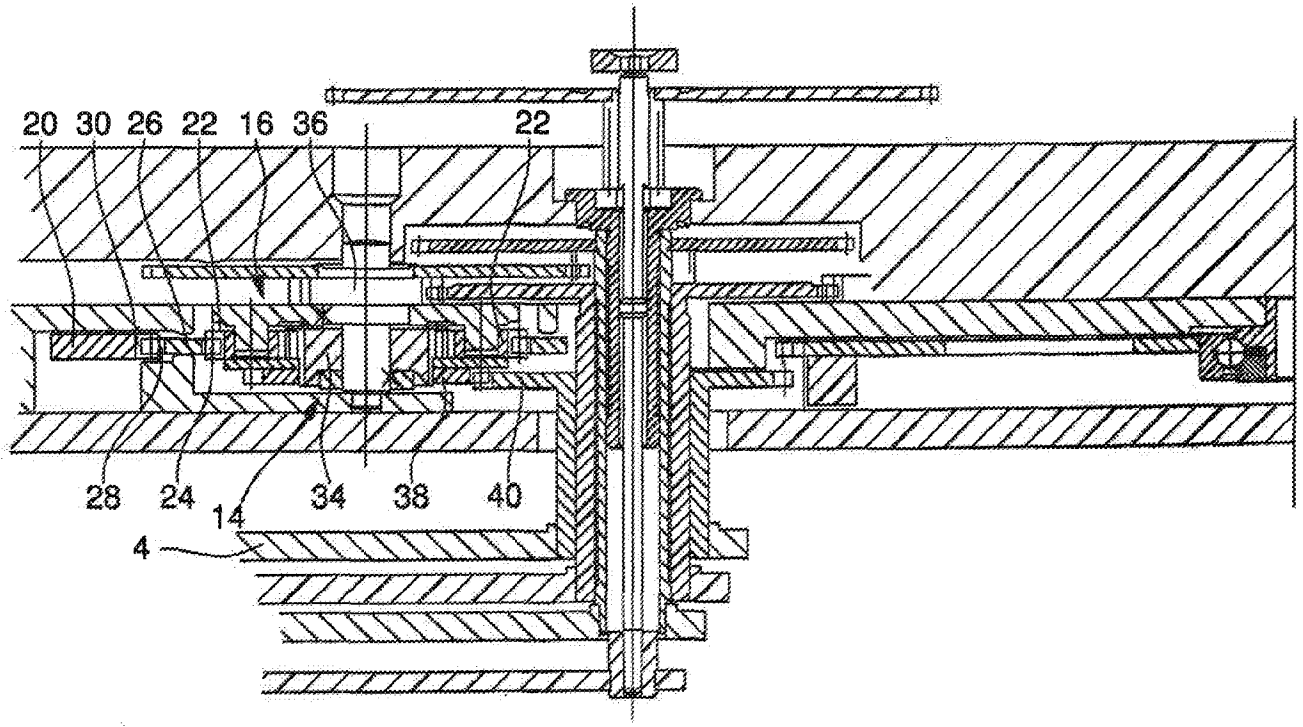
Fig. 2 PRIOR ART
FIG. 2, cited above, is a first cross-section of the running equation of time mechanism shown in FIG. 1.
Figure 3:
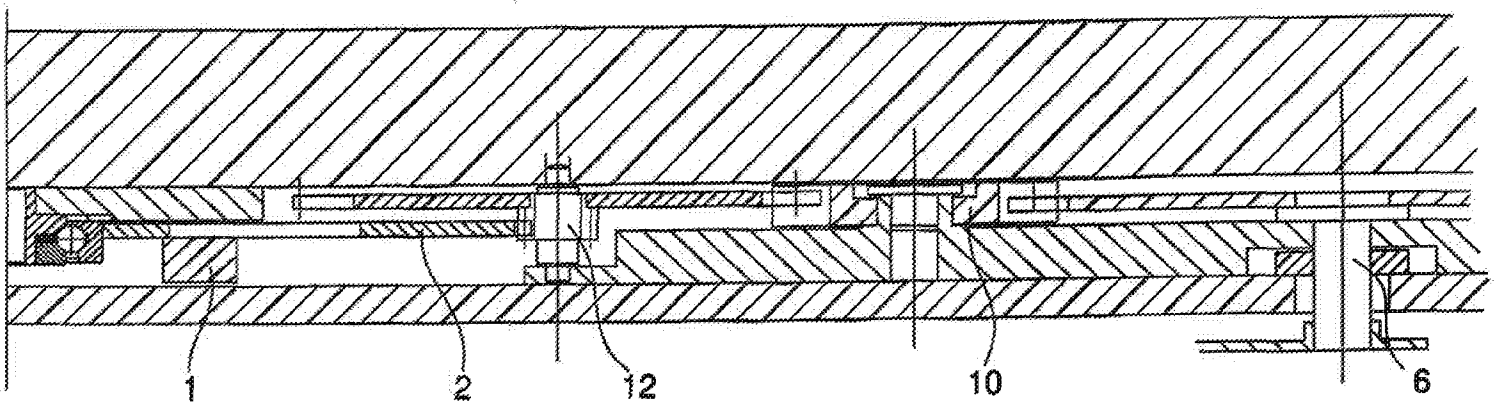
Fig. 3 PRIOR ART
FIG. 3, cited above, is a similar cross-section to that of FIG. 2 in which part of the date mechanism is shown.
Figures 4A, 4B, 4C:
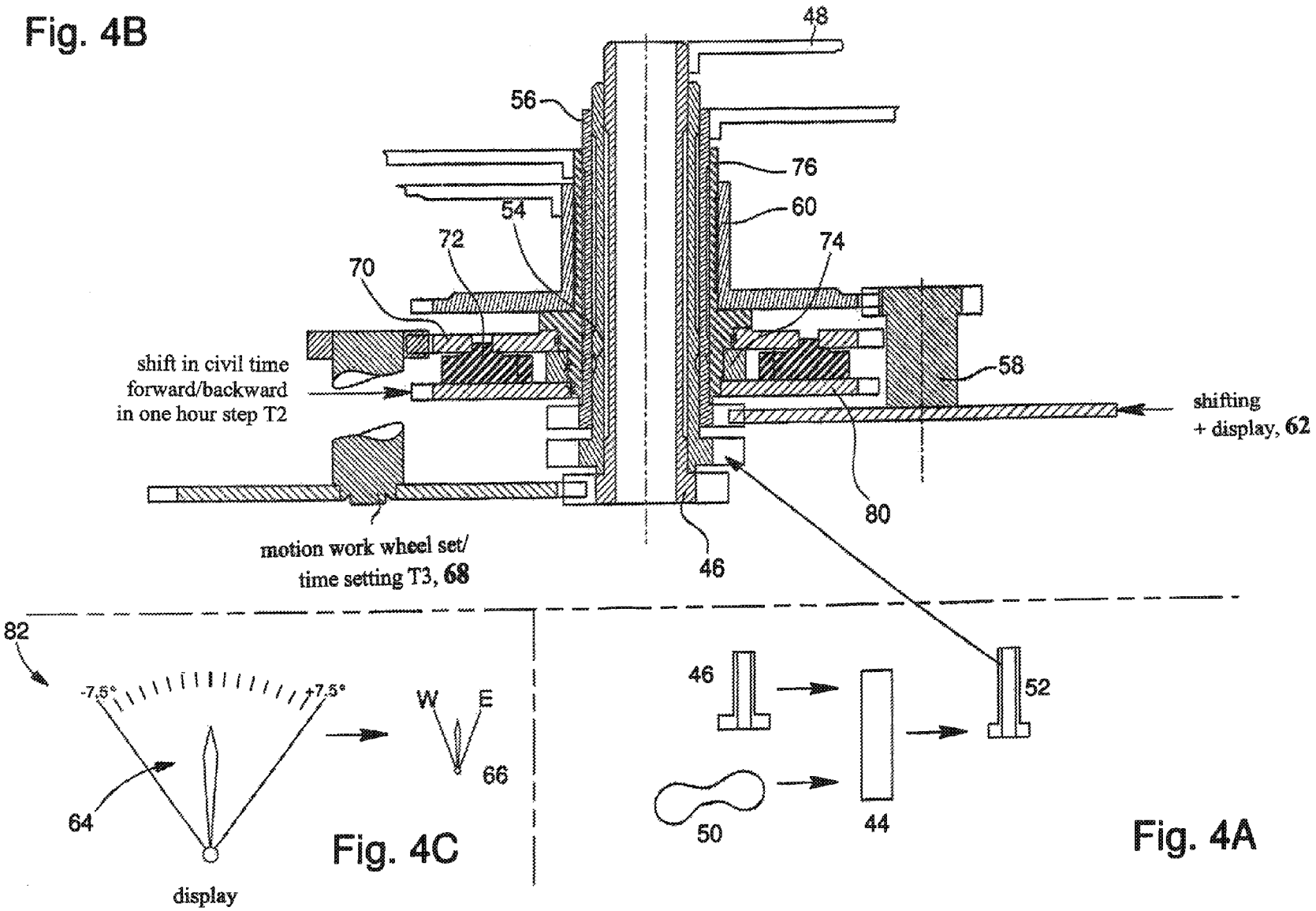
FIGS. 4A, 4B and 4C illustrate a first embodiment of the universal running equation of time mechanism according to the invention.

FIGS. 4A, 4B and 4C illustrate a first embodiment of the universal running equation of time mechanism according to the invention.

Figures 5A, 5B, 5C:
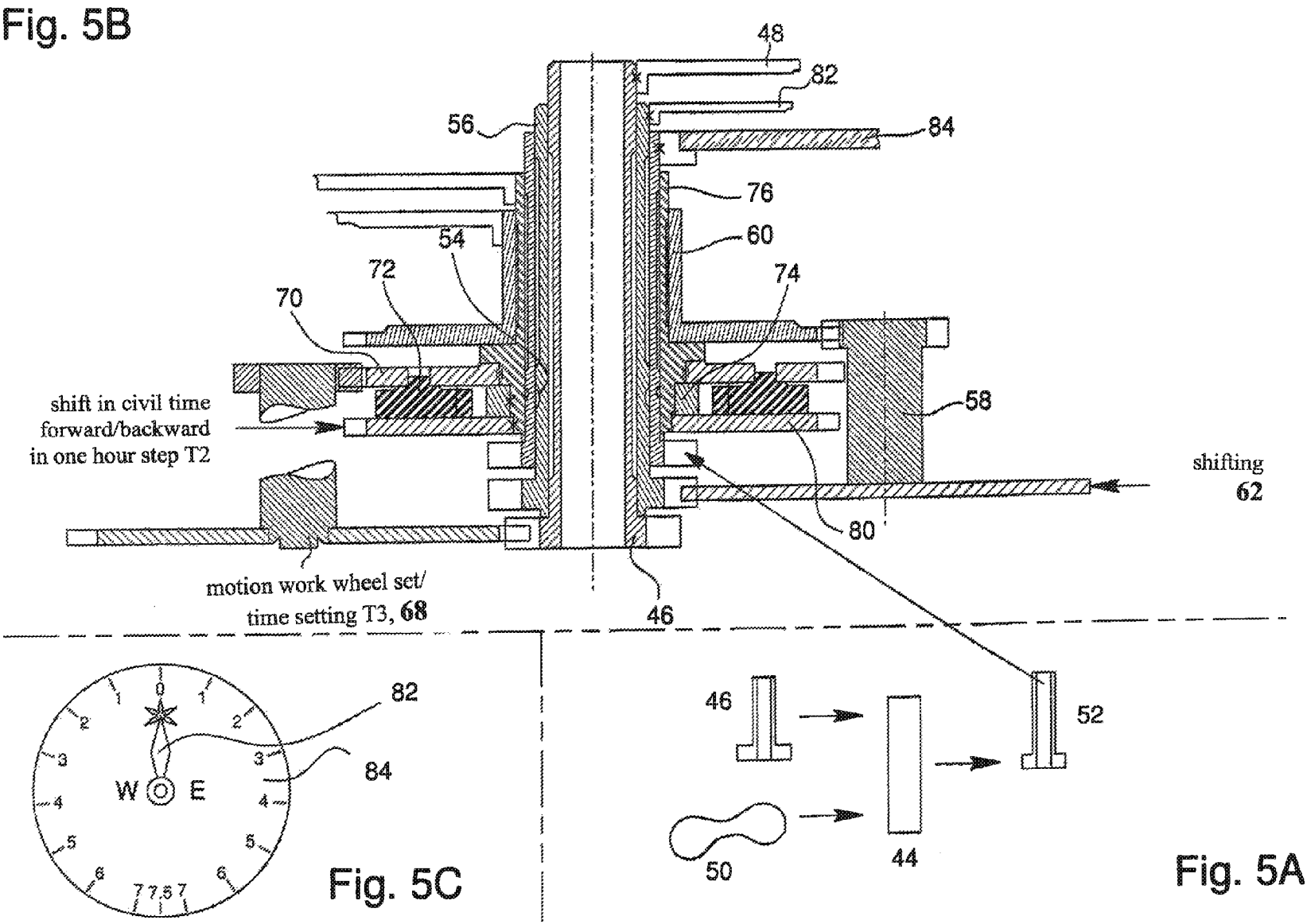
FIGS. 5A, 5B and 5C illustrate a second embodiment of the universal running equation of time mechanism according to the invention.

FIGS. 5A, 5B and 5C illustrate a second embodiment of the universal running equation of time mechanism according to the invention.

FIG. 4A is a diagram of a running equation of time mechanism according to the prior art including a differential device 44 whose respective inputs are a cannon pinion 46 driving a civil time minute hand 48 and an equation of time cam 50. Differential device 44 outputs a running equation minute 52. As mentioned above, running equation minute 52 indicates the difference, for a given day, between civil time and solar time. This difference between civil time and solar time reaches +14 minutes 22 seconds on 11 February and −16 minutes 23 seconds on 4 November.

The difference between civil time and solar time is added to the difference associated with the longitude position of the user relative to the center of the time zone. Indeed, the width of a time zone is 15°, which corresponds to a period of one hour, so that the sun enters the time zone 30 minutes before the official time zone time and leaves 30 minutes after the official time zone time.

This is why, as shown in FIG. 4B annexed to this patent application, the running equation minute 52 drives by friction (indentation) 54 a true running equation minute 56. This true running equation minute 56 differs from running equation minute 52 in that it not only takes account of the difference, for a given day, between civil time and solar time, but also of the longitude position of the user relative to the center of the time zone. True running equation minute 56 in turn drives, via a true equation motion work 58, a true running equation hour 60. A gear train 62 actuatable by the user is coupled to true equation motion work 58. According to a variant embodiment, gear train 62 is directly coupled to true running equation minute 56. This gear train 62 shifts the true running equation minute and hour respectively 56 and 60 according to the longitude position of the user in the time zone. To this end and as illustrated in FIG. 4C annexed to this patent application, gear train 62 carries one or two indications. A first wheel 64 of gear train 62 carries the indication ±7.5° of the offset of the user's position relative to the center of the time zone (in the knowledge that each time zone has a width of 15°) and, optionally, an east or west indication of the offset relative to the center of the time zone.

The introduction of a winter time or summer time or even a different time from the official time zone time will now be considered with reference to FIG. 4B.

The cannon-pinion 46 which carries civil minute 48 drives, in a ratio of 1:12, via a motion work wheel set 68, a wheel 70 for the civil time hours. This civil hour wheel 70 carries a jumper spring 72 driving a star with twelve teeth 74 connected to an arbor 76 carrying a civil hour hand 78 and a time zone wheel 80 which has the same number of teeth as civil hour wheel 70.

The watch according to the invention is fitted with at least one winding stem (not shown) which, in a pushed-in position, enables the watch to be wound and which, in a first pulled-out position, enables the date indication to be set. As will be seen below, in a second pulled-out position T2, the winding stem makes it possible to adjust the difference between civil time at the place where the watch user is situated and the official time at the center of the time zone, and in a third pulled-out position T3, the winding stem enables the time of the watch to be set, i.e. to the watch be set to the time of the place where the watch user is situated.

The time of the watch is set via the winding stem in position T3 and via the motion work wheel set 68. In position T3 of the winding stem, motion work wheel set 68 is operated to move civil minute 48 and civil hour 78 for example to midday. In rotating, motion work wheel set 68 drives cannon-pinion 46 which, it should be recalled, forms one of the inputs of differential device 44. Consequently, the rotation of cannon-pinion 46 causes the rotation of running equation minute 52 which in turn drives true running equation minute 56 and true running equation hour 60. It will be noted that during hand-fitting, i.e. when the various hands are mounted in the factory, it is ensured that the date mechanism is positioned at one of the four days of the year when there is zero difference between civil time and solar time. In that case, when civil minute 48 and civil hour 78 are moved to midday using the winding stem in position T3, the true running equation hour 60 and true running equation minute 56 are also placed at midday.

Once all the hands are moved to midday by actuating the winding stem in position T3, the difference between civil time and the official time at the center of the time zone must be programmed. It will be recalled that this difference is linked to the difference between civil time at the location of the user within the time zone and the time at the center of the time zone. By way of example, for a user located in Switzerland, the difference is +1 hour in winter and +2 hours in summer. The shift in civil time or the change into summer or winter time is achieved via the winding stem in position T2 and via time zone wheel 80 shifting forward or backward in one-hour steps, star wheel 74 with twelve teeth moving from one step to the other on jumper spring 72 and completing 1/12th of a revolution with each step.

At this stage, the following have been programmed in succession: the difference between the civil time minute and the solar time minute, then the difference linked to the longitude position of the user within the time zone, and finally the difference between civil time at the place within the time zone where the watch user is situated and the official time at the center of the time zone. All that remains now is to set the civil time so that it coincides with the time of the place within the time zone where the watch user is located. This time setting is achieved by actuating the winding stem again in position T3. During this operation, the display of civil minute 48 and of civil hour 78 is adjusted so that these hands display the civil time of the place where the user is situated. At the same time, true running equation hour 60 and true running equation minute 56 are moved in the same direction and by the same amount as civil minute 48 and civil hour 78. Finally, the watch displays civil time and the difference between civil time and true solar time.

FIGS. 5A, 5B and 5C annexed to this patent application illustrate a second embodiment of the universal running equation of time mechanism according to the invention. This second embodiment of the invention differs from the first embodiment of the invention illustrated with reference to FIGS. 4A, 4B and 4C only in that a true time minute hand 82 is driven onto the pipe of true running equation minute cannon-pinion 56. This true time minute hand 82 is moved above an offset indicator disc 84 driven onto the pipe of running equation minute cannon-pinion 52. Offset indicator disc 84 carries the indication ±7.5° of the offset of the user's position relative to the center of the time zone (in the knowledge that each time zone has a width of) 15° and an east or west indication of the offset relative to the center of the time zone.

More precisely, it is clear that if the user is in the middle of the time zone, the true time minute hand 82 points to the zero marking on offset indicator disc 84. It is also clear that true time minute hand 82 and offset indicator disc 84 are offset by substantially ±15 minutes relative to civil time minute hand 48, so as to indicate the difference, for a given day, between civil time and solar time. This difference between civil time and solar time reaches +14 minutes 22 seconds on 11 February and −16 minutes 23 seconds on 4 November. Further, true time minute hand 82 is operated independently of offset indicator disc 84 to programme, via difference and display gear train 62, the east or west longitude difference associated with the position of the user relative to the center of the time zone. By way of example, let us assume that it is 21 June. On this date, it is known that the civil time minute is two minutes ahead of the solar time minute. Consequently, if the civil time minute hand 48 is pointing to the zero marking, true time minute hand 82 and offset indicator disc 84 will indicate a difference of −2 minutes. If it is also assumed that the user is, for example, 4° longitude east of the center of the time zone, only true time minute hand 82 will be operated to move said hand into a position 4° longitude east on offset indicator disc 84. Consequently, if on 21 June the user is 4° longitude east of the center of the time zone, civil time minute hand 48 will be at zero, the zero of offset indicator disc 84 will be offset by −2 minutes relative to civil time minute hand 48 and true time minute hand 82 will be offset 4° longitude east relative to offset indicator disc 84, i.e. by +16 minutes. Finally, true time minute hand 82 will be offset by +14 minutes relative to civil time minute hand 48.

It goes without saying that this invention is not limited to the embodiment that has just been described and that various simple alterations and variants can be envisaged by those skilled in the art without departing from the scope of the invention as defined by the claims annexed to this patent application. It will be noted in particular that in position T3 of the winding stem, civil minute 48 and civil hour 78 are operated. The winding stem therefore includes a sliding pinion which will act, via a first gear train, on motion work wheel set 68. Likewise, in position T2 of the winding stem, the difference between civil time at the place where the watch user is located and the official time zone time is introduced. To achieve this, the sliding pinion of the winding stem acts via a second gear train on time zone wheel 80.

The invention claimed is:

1. An universal running equation of time mechanism including a differential device, wherein a first input of the differential device is formed by a cannon-pinion for the civil time minutes and wherein a second input of the differential device is formed by a running equation cam, wherein the differential device outputs on a running equation of time minute pipe a running equation of time minute that indicates the difference, for a given day, between civil time and solar time, wherein the running equation minute drives a true minute pipe of the running equation of time, that, via a true equation motion work, drives a true hour of the running equation of time, wherein the civil time minute cannon-pinion drives via a motion work wheel set, a civil hour wheel, wherein a jumper spring, integral with the civil hour wheel, cooperates with a star having twelve teeth connected to an arbor carrying a civil hour hand, wherein a time zone wheel also is integral with the arbor, wherein a time difference and display train, coupled to the true equation motion work, applies the time difference linked to the longitude position of the user relative to the center of the time zone to the true running equation hour, wherein the time zone wheel applies to the civil hour wheel, in forward or backward one-hour steps, the time difference between the civil time at the place where the user is situated and the time at the center of the time zone, wherein the running equation minute pipe is connected to the true running equation minute pipe by indenting.

2. The running equation of time mechanism according to claim 1, wherein a first wheel of the difference and display train carries the indication ±7.5° of the offset of the position of the user relative to the center of the time zone.

3. The running equation of time mechanism according to claim 2, wherein another wheel of the difference and display train carries an east, west indication of the offset relative to the center of the time zone.

4. The running equation of time mechanism according to claim 1, wherein a true time minute hand is driven onto the pipe of the cannon-pinion for the true running equation minutes, wherein the true time minute hand moves above an offset indicator disc driven onto the pipe of the running equation minute cannon-pinion.

5. The running equation of time mechanism according to claim 2, wherein a true time minute hand is driven onto the pipe of the cannon-pinion for the true running equation minutes, wherein the true time minute hand moves above an offset indicator disc driven onto the pipe of the running equation minute cannon-pinion.

6. The running equation of time mechanism according to claim 3, wherein a true time minute hand is driven onto the pipe of the cannon-pinion for the true running equation minutes, wherein the true time minute hand moves above an offset indicator disc driven onto the pipe of the running equation minute cannon-pinion.

7. The method of setting a universal running equation of time mechanism according to claim 1, wherein it comprises the steps of:

applying the difference, for a given day, between civil time and true time to the true running equation hour;

applying the difference associated with the longitude position of the user relative to the center of a time zone, to the true running equation hour;

applying to the civil hour wheel, in forward or backward steps of one hour, the difference between civil time at the place where the user is located and the time at the center of the time zone; and adjusting the civil time to coincide with the time of the place within the time zone where the watch user is located.

* * * * *